US007093439B2

(12) United States Patent
Pacheco-Tougas et al.

(10) Patent No.: US 7,093,439 B2
(45) Date of Patent: Aug. 22, 2006

(54) HEAT SHIELD PANELS FOR USE IN A COMBUSTOR FOR A GAS TURBINE ENGINE

(75) Inventors: Monica Pacheco-Tougas, Manchester, CT (US); Joseph D. Coughlan, III, S. Glastonbury, CT (US); James B. Hoke, Tolland, CT (US); Alan J. Goetschius, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 458 days.

(21) Appl. No.: 10/147,571

(22) Filed: May 16, 2002

(65) Prior Publication Data

US 2003/0213250 A1 Nov. 20, 2003

(51) Int. Cl.
*F02C 1/00* (2006.01)
*F02G 3/00* (2006.01)

(52) U.S. Cl. ..... 60/752; 60/754; 60/755

(58) Field of Classification Search ..... 60/752, 60/754, 755, 756, 757, 804, 805, 806, 800
See application file for complete search history.

(56) References Cited

U.S. PATENT DOCUMENTS 3,031,844 A * 5/1962 Tomolonius ..... 60/752
3,584,972 A * 6/1971 Bratkovich et al. ..... 416/229 R
3,990,837 A * 11/1976 Snell ..... 60/752
4,168,348 A * 9/1979 Bhangu et al. ..... 428/573
4,180,972 A * 1/1980 Herman et al. ..... 60/800
4,241,586 A 12/1980 Caruel et al.
4,422,300 A * 12/1983 Dierberger et al. ..... 60/757
4,695,247 A * 9/1987 Enzaki et al. ..... 431/352
5,000,005 A * 3/1991 Kwan et al. ..... 60/757
5,209,067 A * 5/1993 Barbier et al. ..... 60/757
5,223,320 A * 6/1993 Richardson ..... 428/137
5,241,827 A * 9/1993 Lampes ..... 60/754
5,279,127 A * 1/1994 Napoli ..... 60/754
5,289,686 A * 3/1994 Razdan et al. ..... 60/755
5,333,443 A * 8/1994 Halila ..... 60/796
5,363,643 A * 11/1994 Halila ..... 60/796
5,396,759 A 3/1995 Richardson
5,435,139 A * 7/1995 Pidcock et al. ..... 60/757
5,483,794 A * 1/1996 Nicoll et al. ..... 60/766
5,758,503 A * 6/1998 DuBell et al. ..... 60/752
5,918,467 A 7/1999 Kwan
5,941,076 A 8/1999 Sandelis
6,199,371 B1 * 3/2001 Brewer et al. ..... 60/766
6,408,629 B1 6/2002 Harris et al.
6,497,105 B1 * 12/2002 Stastny ..... 60/796
6,606,861 B1 * 8/2003 Snyder ..... 60/752
6,701,714 B1 * 3/2004 Burd et al. ..... 60/752

(Continued)

FOREIGN PATENT DOCUMENTS

DE 101 58 548 A1 6/2003

(Continued)

*Primary Examiner*—William Rodriguez
(74) *Attorney, Agent, or Firm*—Bachman & LaPointe, P.C.

(57) ABSTRACT

The present invention relates to heat shield panels or liners to be used in combustors for gas turbine engines. The heat shield panels each comprise a hot side and a cold side and at least one isolated cooling chamber on the cold side. Each cooling chamber has a plurality of cooling film holes for allowing a coolant, such as air, to flow from the cold side to the hot side. A combustor having an arrangement of heat shield panels or liners is also described.

54 Claims, 16 Drawing Sheets

U.S. PATENT DOCUMENTS 6,761,031 B1 * 7/2004 Bunker ..... 60/752

FOREIGN PATENT DOCUMENTS

EP 0 741 268 A1 11/1996
EP 1 098 141 A1 5/2001
EP 1 235 032 A2 8/2002
EP 1 363 078 A2 11/2003
GB 2 361 304 A 10/2001
WO WO 03/006883 A1 1/2003

* cited by examiner

HEAT SHIELD PANELS FOR USE IN A COMBUSTOR FOR A GAS TURBINE ENGINE

BACKGROUND OF THE INVENTION

The present invention relates to combustors for gas turbine engines in general, and to heat shield panels for use in double wall gas turbine combustors in particular.

Gas turbine engine combustors are generally subject to high thermal loads for prolonged periods of time. To alleviate the accompanying thermal stresses, it is known to cool the walls of the combustor. Cooling helps to increase the usable life of the combustor components and therefore increase the reliability of the overall engine.

In one cooling embodiment, a combustor may include a plurality of overlapping wall segments successively arranged where the forward edge of each wall segment is positioned to catch cooling air passing by the outside of the combustor. The forward edge diverts cooling air over the internal side, or hot side, of the wall segment and thereby provides film cooling for the internal side of the segment. A disadvantage of this cooling arrangement is that the necessary hardware includes a multiplicity of parts. There is considerable value in minimizing the number of parts within a gas turbine engine, not only from a cost perspective, but also for safety and reliability reasons. Specifically, internal components such as turbines and compressors can be susceptible to damage from foreign objects carried within the air flow through the engine.

A further disadvantage of the above described cooling arrangement is the overall weight which accompanies the multiplicity of parts. Weight is a critical design parameter of every component in a gas turbine engine, and that there is considerable advantage to minimizing weight wherever possible.

In other cooling arrangements, a twin wall configuration has been adopted where an inner wall and an outer wall are separated by a specific distance. Cooling air passes through holes in the outer wall and then again through holes in the inner wall, and finally into the combustion chamber. An advantage of a twin wall arrangement compared to an overlapping wall segment arrangement is that an assembled twin wall arrangement is structurally stronger. A disadvantage to the twin wall arrangement, however, is that thermal growth must be accounted for closely. Specifically, the thermal load in a combustor tends to be non-uniform. As a result, different parts of the combustor will experience different amounts of thermal growth, stress and strain. If the thermal combustor design does not account for non-uniform thermal growth, stress, and strain, then the usable life of the combustor may be negatively affected.

In many combustors, there is also a problem with damage to the combustor caused by vane bow waves. Failure to counteract got these vane bow waves also shortens the life of the combustor.

SUMMARY OF THE INVENTION

Accordingly, it is an object of the present invention to provide heat shield panels for a combustor of a gas turbine engine which provide effective cooling.

It is a further object of the present invention to provide an improved combustor which has an increased service life.

The foregoing objects are attained by the present invention.

In accordance with a first aspect of the present invention, a heat shield panel or liner for use in a combustor for a gas turbine engine is provided. The heat shield panel broadly comprises a hot side and a cold side and a plurality of cooling chambers on the cold side. Each cooling chamber has a plurality of film holes for allowing a coolant to flow from the cold side to the hot side. The cold side of each heat shield panel also has a front boundary wall, a rear boundary wall, and a plurality of inner rails extending between the front and rear boundary walls. A plurality of cooling chambers are formed by the front and rear boundary walls and the inner rails. The cold side also has a plurality of side walls. A plurality of the cooling chambers are formed by the front and rear boundary walls, the side walls, and the inner rails.

The heat shield panels described herein are forward heat shield panels and rear heat shield panels. In a first embodiment of a forward heat shield panel, the front wall is formed by a forward wall segment. In a second embodiment of a forward heat shield panel, the front wall is formed by means for metering flow of cooling air over an edge of the panel. The metering means is preferably formed by a plurality of spaced apart pins. In a first embodiment of a rear heat shield panel, the rear boundary is formed by a rear wall. In a second embodiment of a rear heat shield panel, the rear boundary is formed by a means for metering flow of cooling over an edge of the panel. The metering means preferably comprises a plurality of pin arrays.

The present invention also relates to a combustor for a gas turbine engine. The combustor broadly comprises an outer support shell and an inner support shell which together form a combustion chamber. The combustor further comprises an array of forward heat shield panels attached to the inner and outer support shells and an array of rear heat shield panels attached to the inner and outer support shells. The forward heat shield panels each have a plurality of dilution holes through which air passes into the combustion chamber. The rear heat shield panels each have a plurality of rails. Each rear heat shield panel is offset with respect to an adjacent one of the forward heat shield panels so that each rail is aligned with one of the dilution holes.

In yet another embodiment of the present invention, a heat shield panel is provided which has at least one chamber, a first set of cooling holes passing through the heat shield panel, and a second set of cooling holes passing through the heat shield panel. The first set of cooling holes has an orientation different from the second set of cooling holes.

Other details of the gas turbine combustor of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
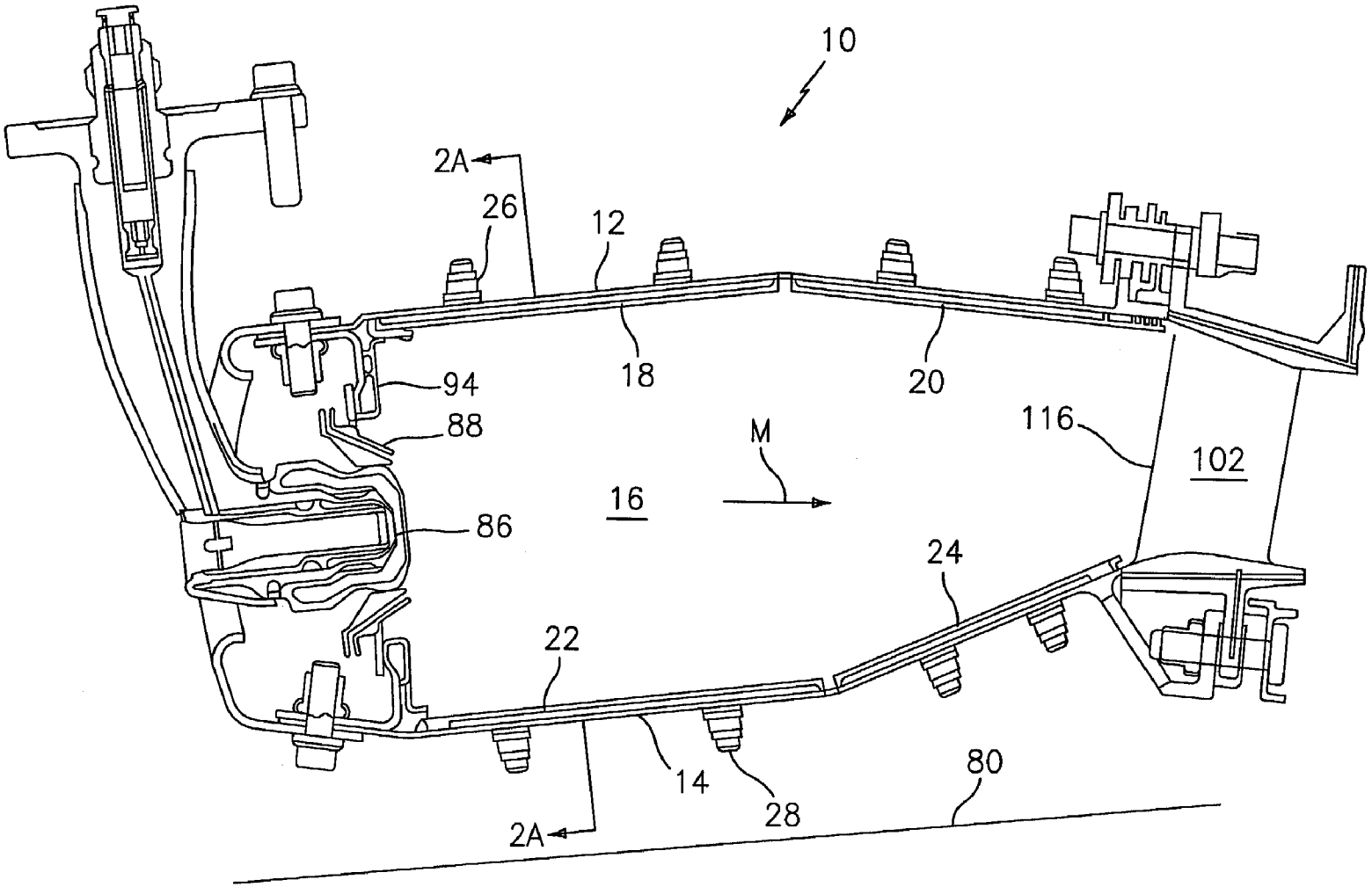
FIG. 1 is a sectional view of a combustor for a gas turbine engine.

Referring now to FIG. 1, the combustor 10 for a gas turbine engine comprises a radially outer support shell 12 and a radially inner support shell 14. The support shells 12 and 14 define an annular combustion chamber 16. The combustion chamber has a mean combustor airflow in the direction M.

Heat shield panels or liners line the hot side of the inner and outer support shells 12 and 14. An array of forward heat shield panels 18 and an array of rear heat shield panels 20 line the hot side of the outer support shell 12, while an array of forward heat shield panels 22 and an array of rear heat shield panels 24 line the hot side of the inner support shell 14. Nuts 26 and bolts 28 may be used to connect each of the heat shield panels 18, 20, 22, and 24 to the respective inner and outer support shells 14 and 12.

Figure 2:
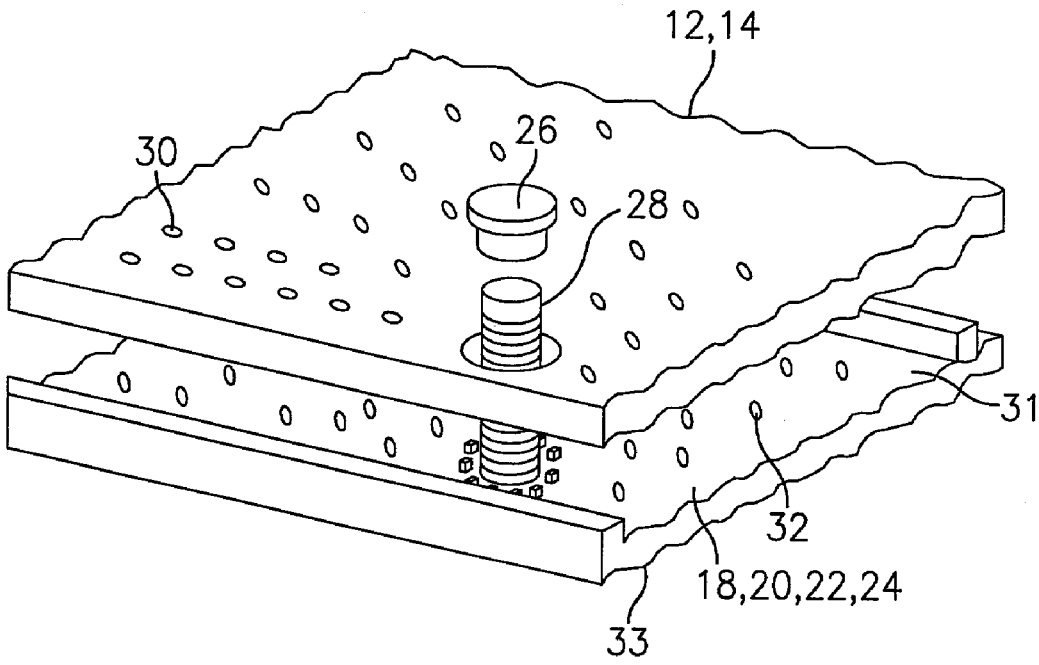
FIG. 2 is a partial view of a shell and a heat shield panel liner in the combustor of FIG. 1.
Figure 2A:
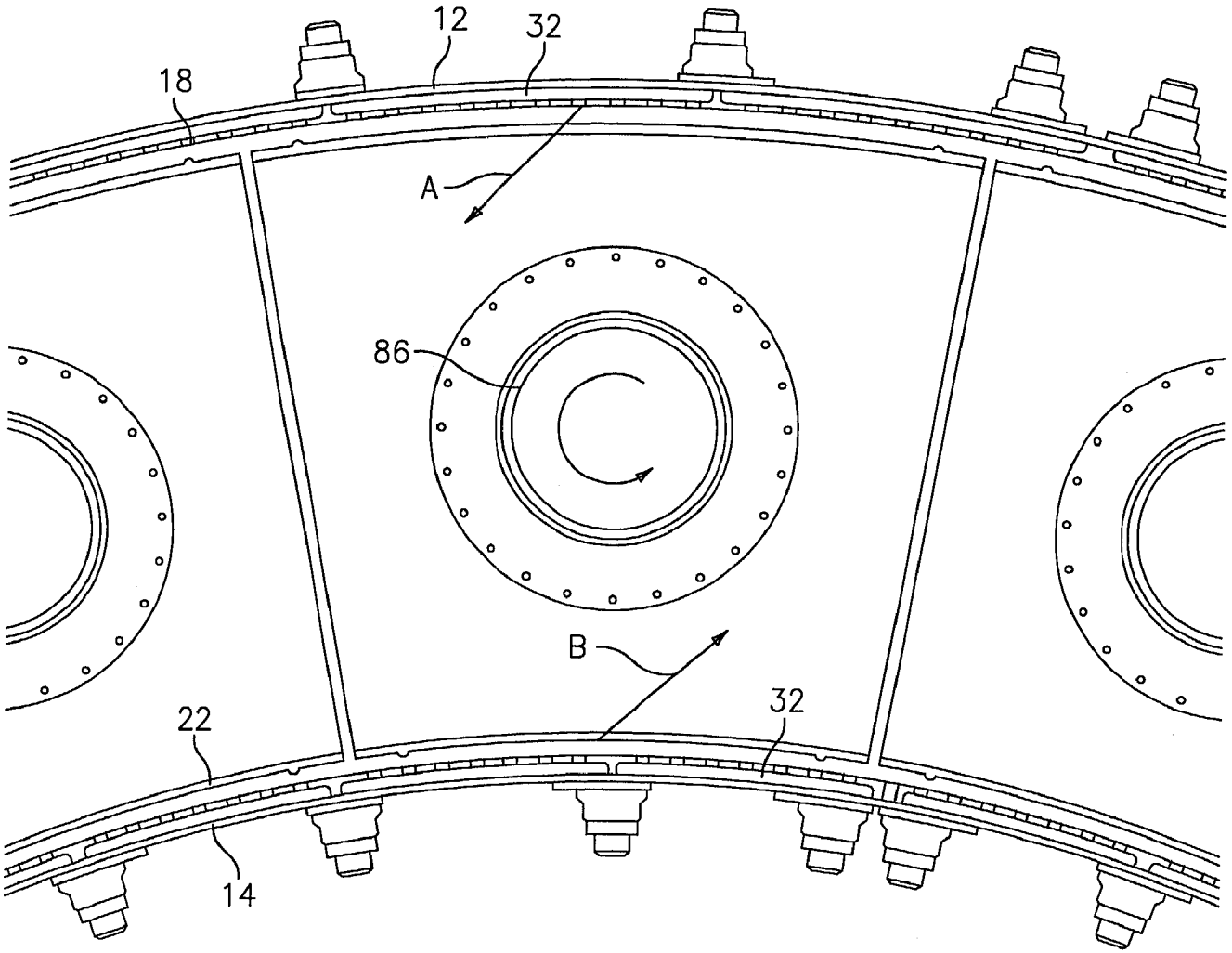
FIG. 2A is a sectional view of the combustor taken along lines 2A—2A in FIG. 1.

As shown in FIG. 2, impingement cooling holes 30 penetrate through each of the inner and outer support shells 14 and 12 to allow a coolant, such as air, to enter the space between the inner and outer support shells 14 and 12 and the respective panels 18, 20, 22 and 24. Film cooling holes 32 penetrate each of the heat shield panels 18, 20, 22, and 24 to allow cooling air to pass from a cold side 31 of the panel to a hot side 33 of the panel and to promote the creation of a film of cooling air over the hot side 33 of each panel. FIG. 2A shows that a majority of the cooling air flow passing through the cooling holes 32 in the forward outer heat shield panels 18 has a first flow direction A, while a majority of the cooling air flow passing through the cooling holes 32 in the forward inner heat shield panels 22 has a second flow direction B, which flow direction is different from the first flow direction A.

Figure 3:
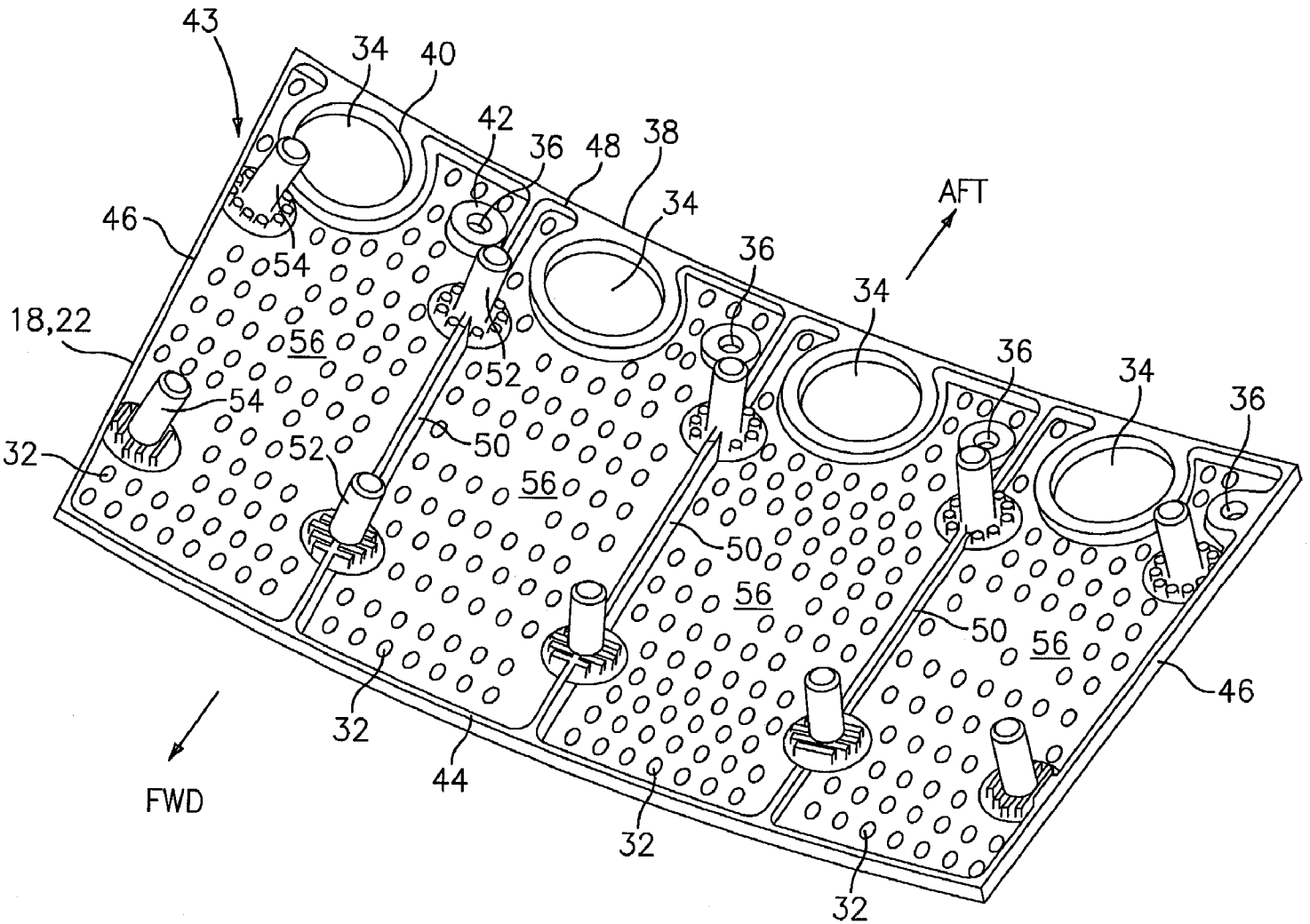
FIG. 3 is a top view of a cold side of each of the forward heat shield panels used in the combustor of FIG. 1.

Referring now to FIG. 3, each of the forward panels 18 and 22, on its cold side 31, has circumferentially distributed major dilution holes 34 and minor dilution holes 36 near the panel's trailing edge 38. Raised rims 40 circumscribe each major dilution hole 34 and raised rims 42 circumscribe each minor dilution hole 36. In a fully assembled combustor, the major dilution holes 34 and the minor dilution holes 36 of opposite panels radially oppose each other.

Each of the forward heat shield panels 18 and 22 further have a peripheral boundary wall 43 formed by forward wall segment 44, side wall segments 46, and rear wall segment 48. The peripheral boundary wall 43 formed by these segments extends radially and contacts the support shell 12 or 14. Each of the forward heat shield panels 18 and 22 preferably subtends an arc of approximately 40 degrees.

As can be seen from FIG. 3, each of the forward heat shield panels 18 and 22 includes a plurality of inner rails or ribs 50 that extend axially from the forward peripheral wall segment 44 to the aft peripheral wall segment 48. There are two attachment posts 52 typically aligned with each rail 50 and two additional attachment posts 54 positioned next to each side peripheral wall segment 46. The rails 50 are the same radial height as the peripheral walls segments 44, 46, and 48. The rails 50 define a plurality of circumferentially aligned, isolated cooling chambers 56 with the peripheral wall segments 44, 46, and 48. The rails 50 also provide structural support for the forward heat shield panels 18 and 22.

The creation of separate cooling chambers 56 is advantageous in that the cooling chambers 56 provide an even distribution of cooling air throughout the panels 18 and 22 by maintaining an optimum pressure drop through each panel section created by the axial inner rails 50 and the peripheral wall segments 44, 46, and 48. This pressure drop drives cooling air into every cooling film hole 32 in the respective heat shield panel 18 and 22 in each section in such a way that the respective heat shield panel 18 and 22 is optimally cooled by convection through the film holes 32 and by an even film flow.

If a heat shield panel were to have a region with a large open area compared to the rest of the panel, a breach, e.g. a burn-through, can cause coolant to preferentially flow through this large area as it offers less resistance to the flow. In such a case, the film holes away from this area will be starved of coolant and the cross-flow of air in the cavity that travels toward the large open area will decrease the effect of the impingement jets that it encounters in its trajectory. The combination of these two phenomena will cause an increase in metal temperature in the panel. These problems are avoided by the forward heat shield panels 18 and 22 of the present invention and the creation of the isolated cooling chambers 56. If a major breach occurs in one of the heat shield panels 18 and 22, the increase in metal temperature will be limited to the cooling chamber 56 where the breach is located, leaving the other cooling chambers 56 operating at the design temperature and the entire heat shield panel safety in place. As one can see from the foregoing discussion, if a forward heat shield panel is not equipped with separate or isolated cooling chambers 56 as in the present invention, any temperature increase will occur in a larger area of the heat shield panel causing the burn-through to expand to the entire heat shield panel. Under these circumstances, the release of a panel or a section of it, when attachment posts are lost, is unavoidable. There is a high risk of engine fire once a blade or vane in the turbine module is damaged due to rupture or burning. The forward heat shield panels 18 and 22 with their separate cooling chambers 56 avoid this problem.

Figure 5:
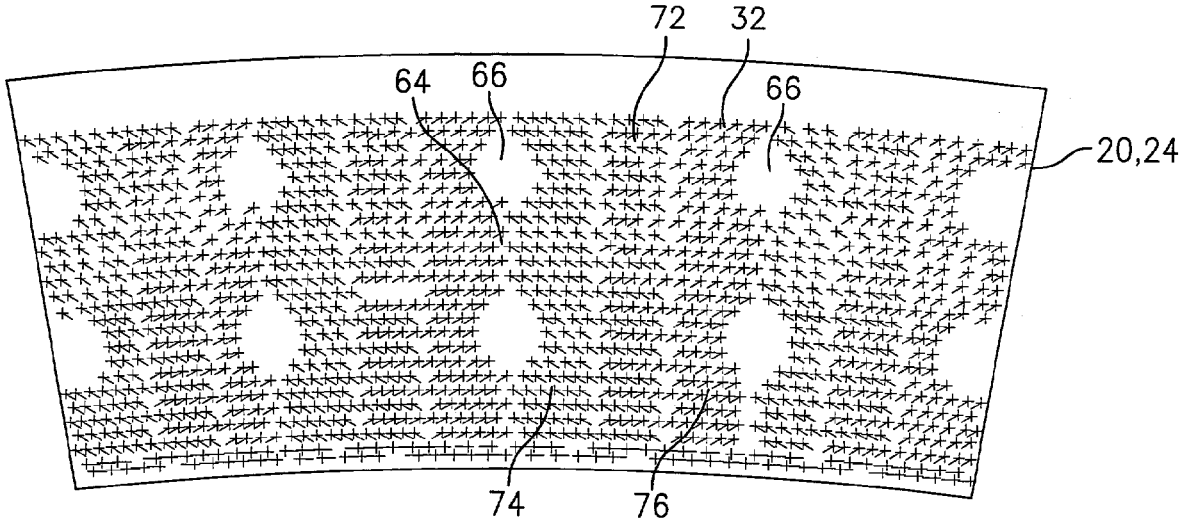
FIG. 5 is a view showing the arrangement of adjoining forward and rear heat shield panels in a combustor.
Figure 5:
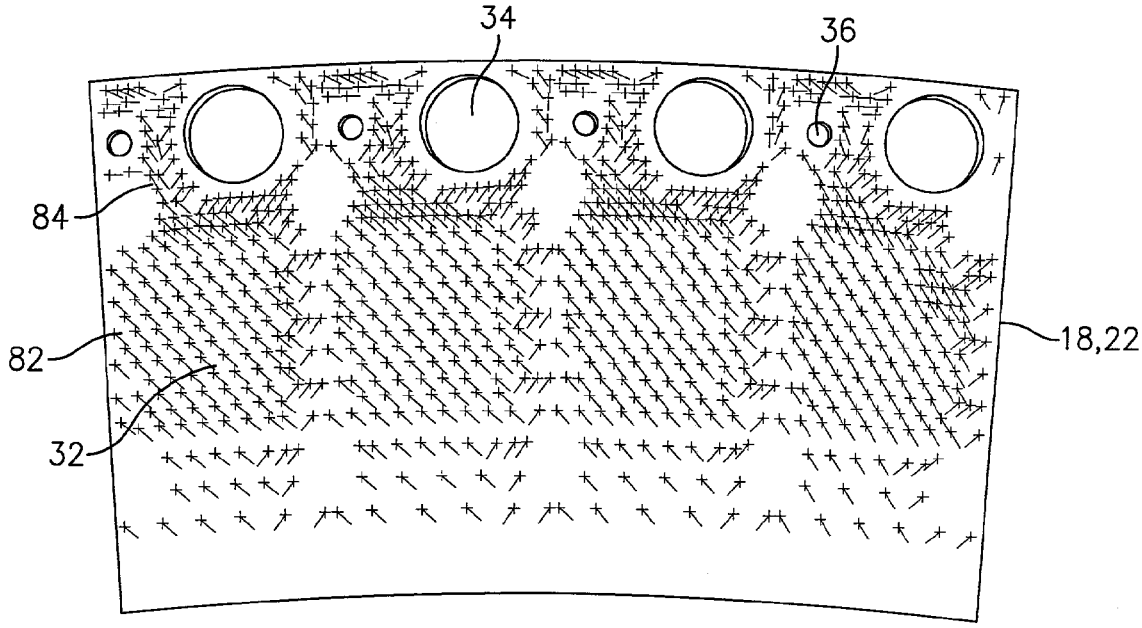

Referring now to FIG. 5, there are two particularly relevant regions in each forward heat shield panel 18 and 22—the region 82 forward of the dilution holes 34 and the region 84 near the dilution holes 34. The cooling holes 32 in the forward region 82, as shown in FIG. 2A, have an orientation consistent with the local swirl direction of the combustion gases. The general direction of swirl in the vicinity of the front outer heat shield panels 18 is opposite the direction of swirl in the vicinity of the forward inner heat shield panels 22. Streams emanating from each fuel injector 86 and each fuel injector guide 88 establish the swirl direction. Accordingly, and except as noted in the next paragraph, the film cooling holes 32 in the outer front heat shield panels 18 all have a positive circumferentially oblique orientation, whereas the film cooling holes 32 in the inner front heat shield panels 22 all have a negative circumferential oblique orientation. This can be seen in FIG. 2A. The film cooling holes 32 in any given panel 18 or 22 do not have the mix of positive and negative orientations on either side of the cooling chamber mean line, as is the case with the rear heat shield panels 20 and 24.

Figure 5A:
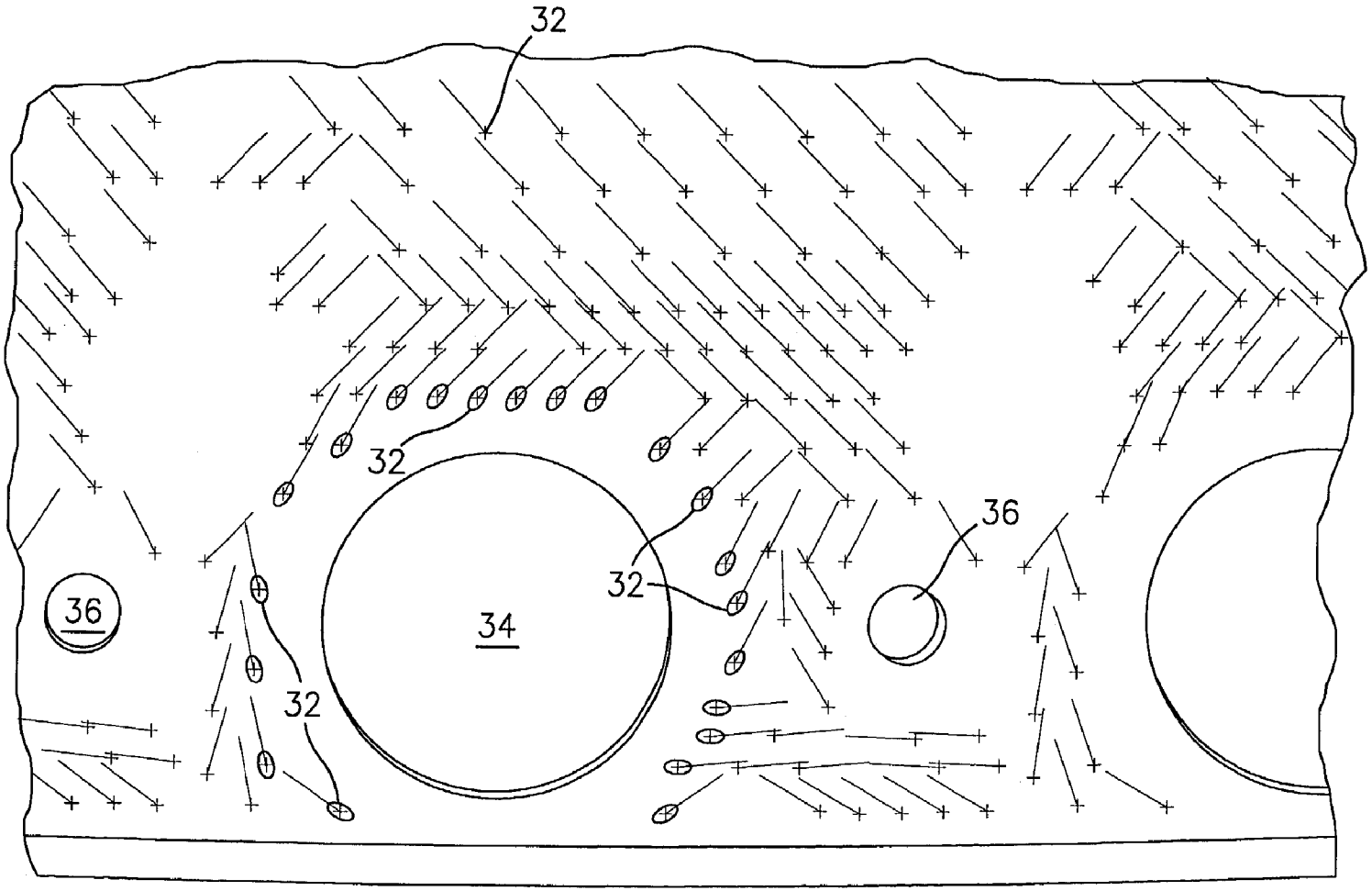
FIG. 5A is an enlarged view of a portion of a forward heat shield panel.

The one exception to the cooling hole orientation described above for the heat shield panels 18 and 22 occurs in the vicinity of the axially extending rails 50 and the attachment posts 52. As shown in FIGS. 5 and 5A, the orientation of the cooling holes 32 on each side of each rail 50 is towards the respective rail 50. Further, cooling holes 32 in the vicinity of each attachment post 52 are oriented so that cooling air flows toward the attachment post 52. The cooling holes 32 are locally reversed so that film air is directed towards and over the rail 50 and the footprints of the posts 52. This is done to better cool the rail and post footprints.

As shown in FIGS. 5 and 5A, in the vicinity of the dilution holes 34, the concentration of film cooling holes 32, as well as the concentration of the impingement holes 30 shown in FIG. 2, is increased as compared to the region 82. Further, the cooling holes 32 in the vicinity of each dilution hole 34 are oriented towards the respective dilution hole 34. This is done to increase the heat extraction on the panel in a region where the fuel spray cone from the injector 86, and its associated hot gases, have expanded in diameter and scrub the heat shield panels 18 and 22. Additionally, the interaction of the fuel injector stream with the dilution jets generates high velocity and high turbulence flows and vortices around the dilution holes that diminish the effectiveness of the cooling film. Both of these factors help increase the local heat load on the panel. Therefore, more cooling air through the impingement and film cooling holes 30 and 32 respectively are needed to cool the panel adequately. As can be seen in FIG. 5A, in the vicinity of the dilution holes 34, the film cooling holes 32 are arranged in a fan like pattern. This deviation from the orientation of the film cooling holes 32 in the rest of the respective heat shield panel 18 or 22 allows for the direct injection of cooling film air over the footprint of the raised rims 40 and 42 of the respective dilution hole 34 or 36. If one were to keep the film hole orientation of the forward region of the heat shield panel, which is unidirectional, one-half of the raised rim footprint 40 or 42 of the dilution hole 34 or 36 would get no cooling film. Due to the high heat load on this region of the panel, as indicated above, an uncooled panel area is extremely undesirable.

Figure 4:
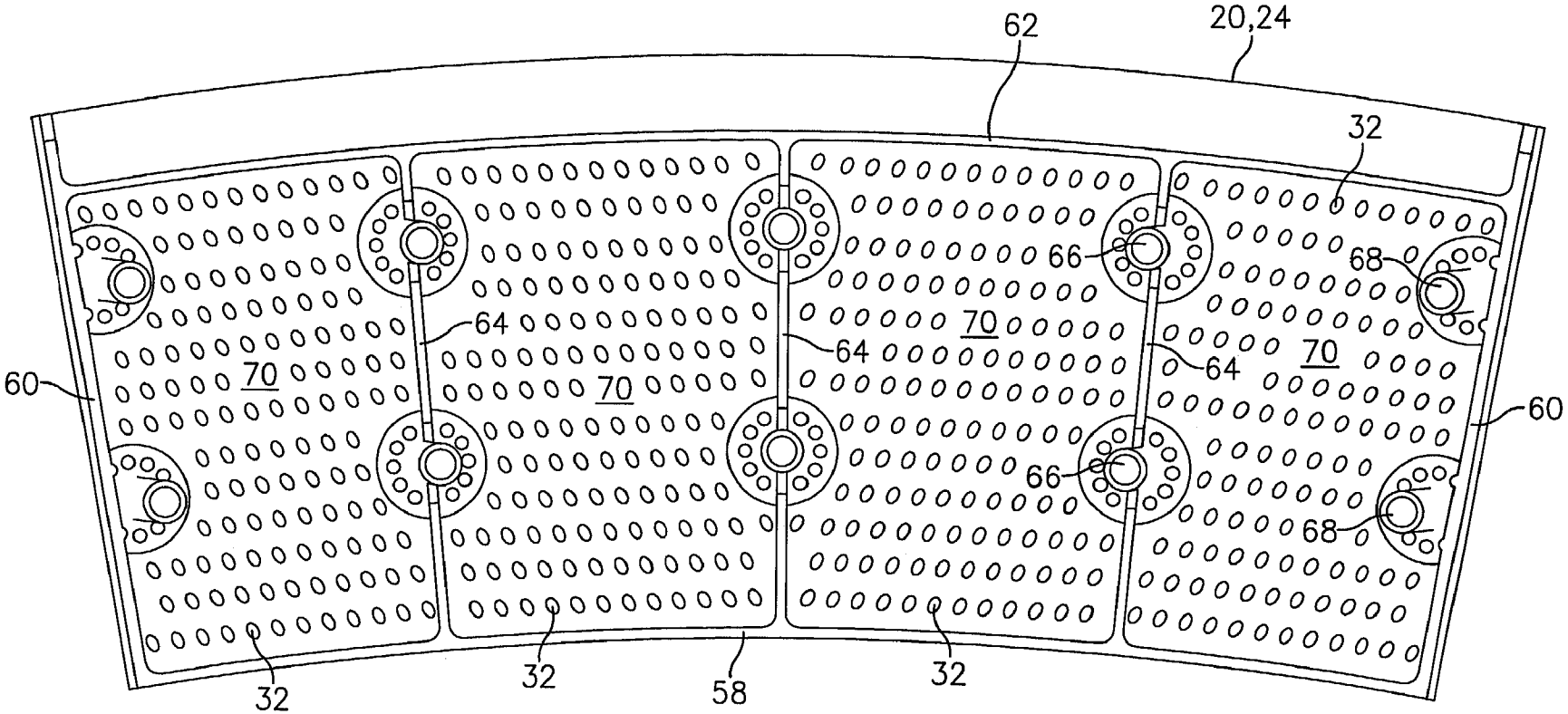
FIG. 4 is a view of the cold side of a rear heat shield panel.

Referring now to FIG. 4, each of the rear heat shield panels 20 and 24, on its cold side, has a peripheral boundary wall formed by forward wall segment 58 and side wall segments 60. Each heat shield panel 20 and 24 also has a rear rail 62 extending from one side wall segment 60 to the opposite side wall segment 60 and a plurality of inner rails 64 extending between the forward wall segment 58 and the rear rail 62. Two attachment posts 66 are typically aligned with each inner rail 64 and two attachment posts 68 are located adjacent each of the side wall segments 60. As in the forward heat shield panels, the peripheral wall segments 58 and 60, the rear rail 62, and the inner rails 64 define a plurality of circumferentially aligned, isolated cooling chambers 70.

Figure 5B:
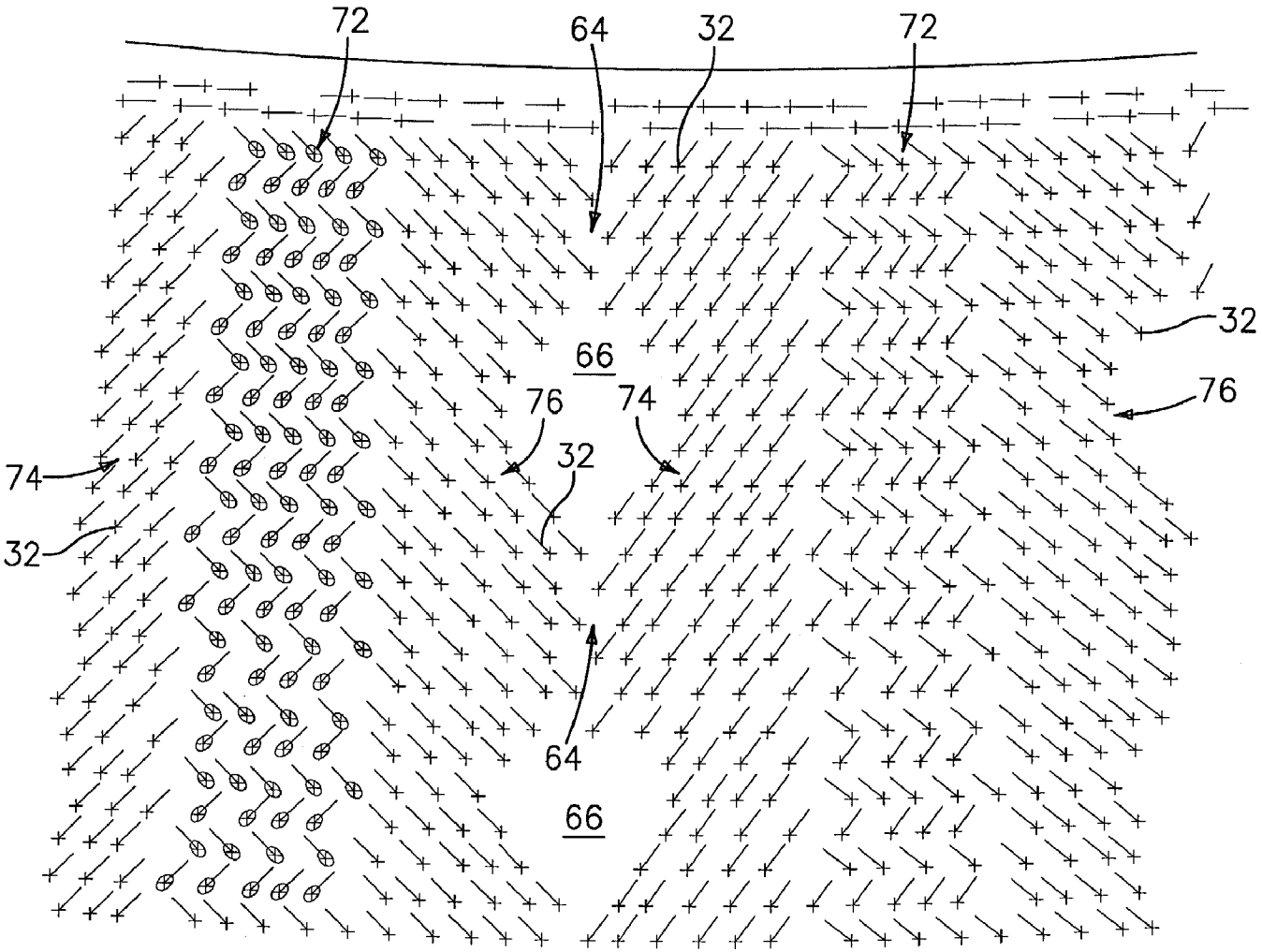
FIG. 5B is an enlarged view of a portion of a rear heat shield panel.
Figure 5C:
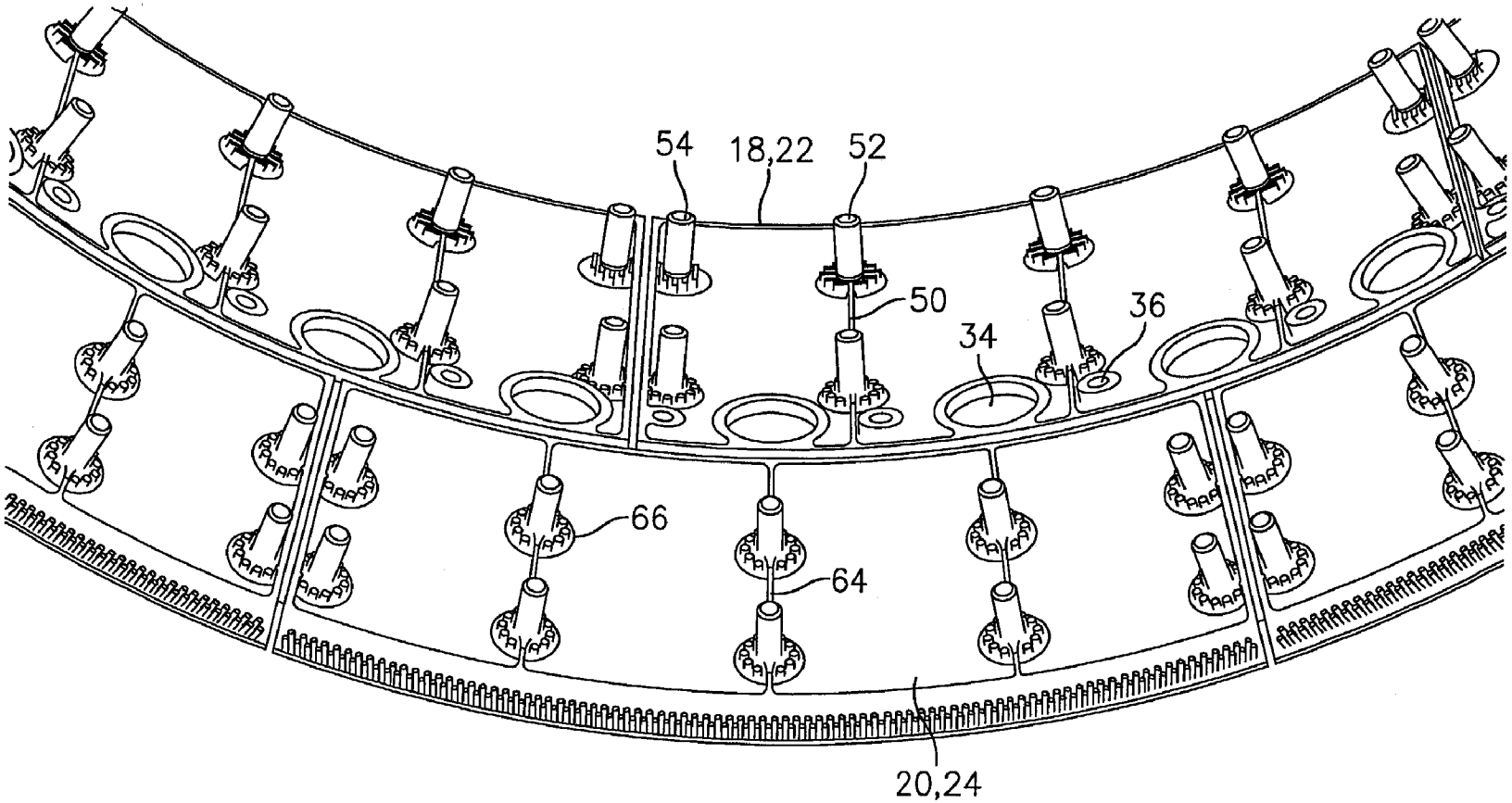
FIG. 5C is a schematic representation of the alignment of the forward heat shield panels with the rear heat shield panels.

As can be seen in FIGS. 5 and 5C, each rear heat shield panel 20, 24 is arranged relative to a respective adjacent forward heat shield panel 18, 22 so that each of the inner rails 64 is circumferentially aligned with a major dilution hole 34. More fundamentally, the rails 64 are circumferentially offset from the major dilution holes 34 of the radially opposing liner panel and thus from the major dilution air jets admitted through the major dilution holes 34.

The advantage of the arrangement shown in FIG. 5 arises from the fact that the footprint of each rail 64 and each attachment post 66 is inherently difficult to cool. The difficulty in cooling these footprints occurs for two reasons. First, one cannot effectively impinge cooling air on the rails 64 or posts 66 because they contact the support shell 12, 14 in order to define the isolated cooling chambers 70 as described above. Second, the rails 64 and posts 66 occupy enough circumferential distance that it is difficult to establish an effective cooling film over the footprints, even if one uses film holes positioned quite close to them and oriented so as to discharge their cooling film in the direction of the footprint. This inability to effectively cool the footprints would be exacerbated if the footprints were to be circumferentially aligned with a major dilution hole 34 of the radially opposed heat shield panel. This is because the major dilution jets penetrate across the annulus and scrub the radially opposing heat shield panel. This scrubbing effect can diminish the cooling effectiveness of the cooling film on the radially opposing heat shield panel or might even scrub the cooling film off the radially opposing liner, thus directly exposing the heat shield panel to the hot stoichiometric shear layer of the dilution jet. By contrast, the minor dilution jets issuing from the minor dilution holes 36 do not penetrate completely across the annulus. Therefore, it is advantageous to circumferentially align the rail footprint, and hence the attachment posts 66, with a radially opposing minor dilution hole 36, or at least not to align the footprint with a major dilution hole 34.

As shown in FIGS. 5 and 5B, each of the rear heat shield panels 20, and 24, in the vicinity of each cooling chamber 70, has an axially extending zigzag line 72 which is located circumferentially midway between the inner rails 64 and/or the side wall segment 60 defining the side boundaries of a respective cooling chamber 70. The film cooling holes 32 on either side of each zigzag line 72 are obliquely oriented so that the cooling film issues from the film cooling holes 32 with a circumferential directional component toward the rail or wall segment footprint on the same side of the zigzag line 72. Thus, the holes 32 on one side 74 of each zigzag line 72 have a positive orientation, whereas the holes 32 on the other side 76 of the zigzag line 72 have a negative orientation. The resultant circumferential directional component encourages the cooling film to flow over the rail and attachment post footprints, thus helping to cool the rails and the posts. The zigzag line 72 is defined such that the film hole orientation change varies circumferentially by a few degrees from row to row of cooling holes 32. By doing so, the area without any cooling film coverage is kept to a minimum. If one were to define the film hole orientation change at the same circumferential location on every row of film holes 32, for example at the mean line of each cooling chamber 70, there would be a well defined axial stretch of panel with no cooling film coverage. This has been proven to increase the metal temperature in this area above the level required for a full-life combustor. Another advantage to the positive and negative orientations of the film cooling holes 32 in the heat shield panels 20, 24 is that it helps to preserve the film on the downstream side of the major dilution jets, which enter the combustion chamber 16 immediately forward of the rear heat shield panels 20 and 24. Wake or tornado-like vortices form downstream of a jet issuing transversely into a stream and such vortices originate in the boundary layer of the cross-flow after it separates from the wall from which the jet issues. The cooling film injected around and behind the dilution air jet is going to be part of these wake vortices and, therefore, be blown off the panel surface. An area where the film has blown off will show an increase in metal temperature due to the lack of protection from hot combustion gases that the film offers. The circumferential orientation of the film holes 32 in the rear heat shield panels 20 and 24 behind the dilution jet enforces or eliminates these wake vortices. Film holes circumferentially oblique with respect to the engine centerline result in high panel temperatures immediately downstream of the dilution jet with a patch of increased metal temperature further downstream. The fact that the patch follows the circumferential orientation of the film holes indicates that the wake vortices on either side of the jet, while pulling cooling film off the surface, has the same rotational direction as that of the film holes. On the contrary, film holes 32, such as those of the present invention, that behind the dilution jet are oriented circumferentially oblique directed toward the dilution symmetry plane 78, show no increase in metal temperature and no effect on the film effectiveness downstream of the dilution jet. Injecting film in opposing oblique orientation behind a transverse jet impedes the formation of wake vortices.

Figure 6:
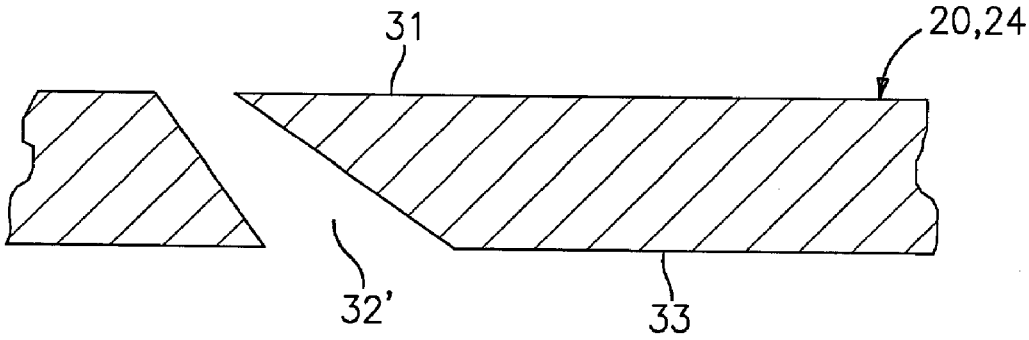
FIG. 6 is a sectional view showing a cooling film hole used in the heat shield panels of the present invention.

There is one localized region of each rear heat shield panel 20, 24 where the film cooling holes 32 are not obliquely oriented as described above. The holes 32 in the vicinity of the upstream peripheral wall segment 58 are oriented at 90 degrees so that the cooling film issues from these holes in the circumferential direction. There are two reasons for this. First, the film holes are percussion drilled from the hot side of the panel rather than from the cold side of the panel. This is the preferred direction of drilling because it results in a trumpet shaped hole 32' as shown in FIG. 6. The trumpet shaped hole 32' has a relatively small diameter on the cold side 31 of the panel 20, 24 and a relatively large diameter on the hot side 33 of the panel 20, 24. This is desirable because the larger diameter on the hot side 33 helps to diffuse the cooling film and encourage the film to adhere and spread on the hot side surface rather than penetrate into the combustion chamber 16. The 90 degree orientation also helps avoid structural damage to the panel during formation of the holes 32'. Second, the 90 degree orientation allows for a relatively small axial distance between consecutive rows of holes and for the first row to be located extremely close to the peripheral rail wall segment 58. This, in turn, increases the heat extraction through convection in this critical region of the panels 20 and 24 where the film has not yet been established and where no impingement is possible on the rails.

In an alternative embodiment of the panels 20 and 24, the oblique cooling film holes 32 may be limited to those holes that are circumferentially proximate the rails 64. In this hybrid embodiment, the remaining cooling film holes 32, i.e. those closer to the mean line of the cooling chamber 70, are oriented at zero degrees, which is parallel to the mean combustor airflow direction M, or at ninety degrees, which is perpendicular to the mean combustor airflow direction M. The selection of either one of these embodiments, including the universally oblique orientation described above, strongly depends on the local and mean velocities and turbulence level of the external combustor flow, the impingement and film hole densities, i.e. axial and circumferential spacing between consecutive holes, and the panel geometry. On a rear heat shield panel 20, 24, the zero degree orientation, with similar hole density as the other embodiments, may result in the lowest metal temperatures compared to the other orientations, i.e. universally oblique and the ninety degree. The universally oblique orientation however may be beneficial in the rear heat shield panel 20, 24 as compared to the zero and ninety degree orientation.

Figure 7:
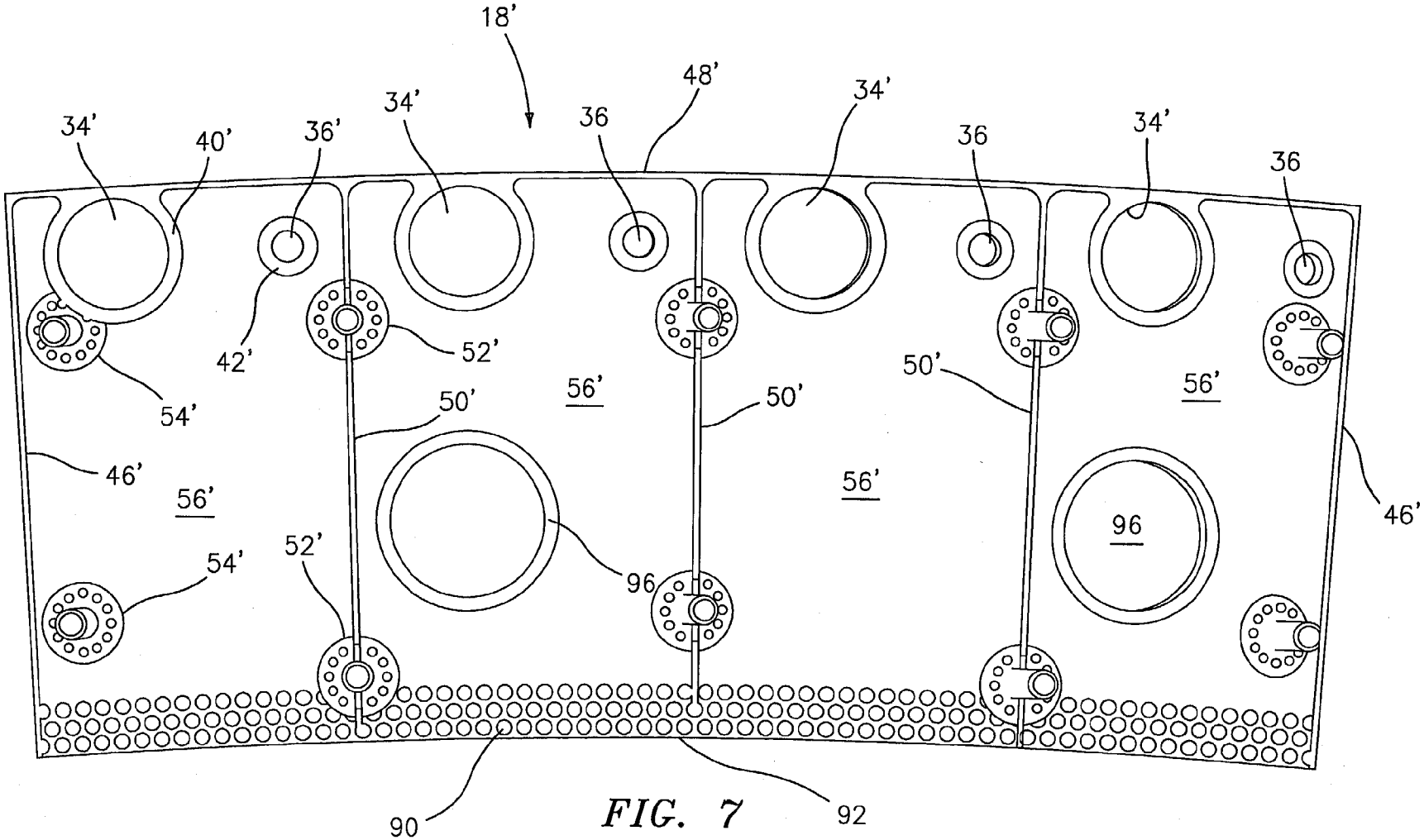
FIG. 7 is a view of an alternative embodiment of an outer forward heat shield panel.
Figure 8:
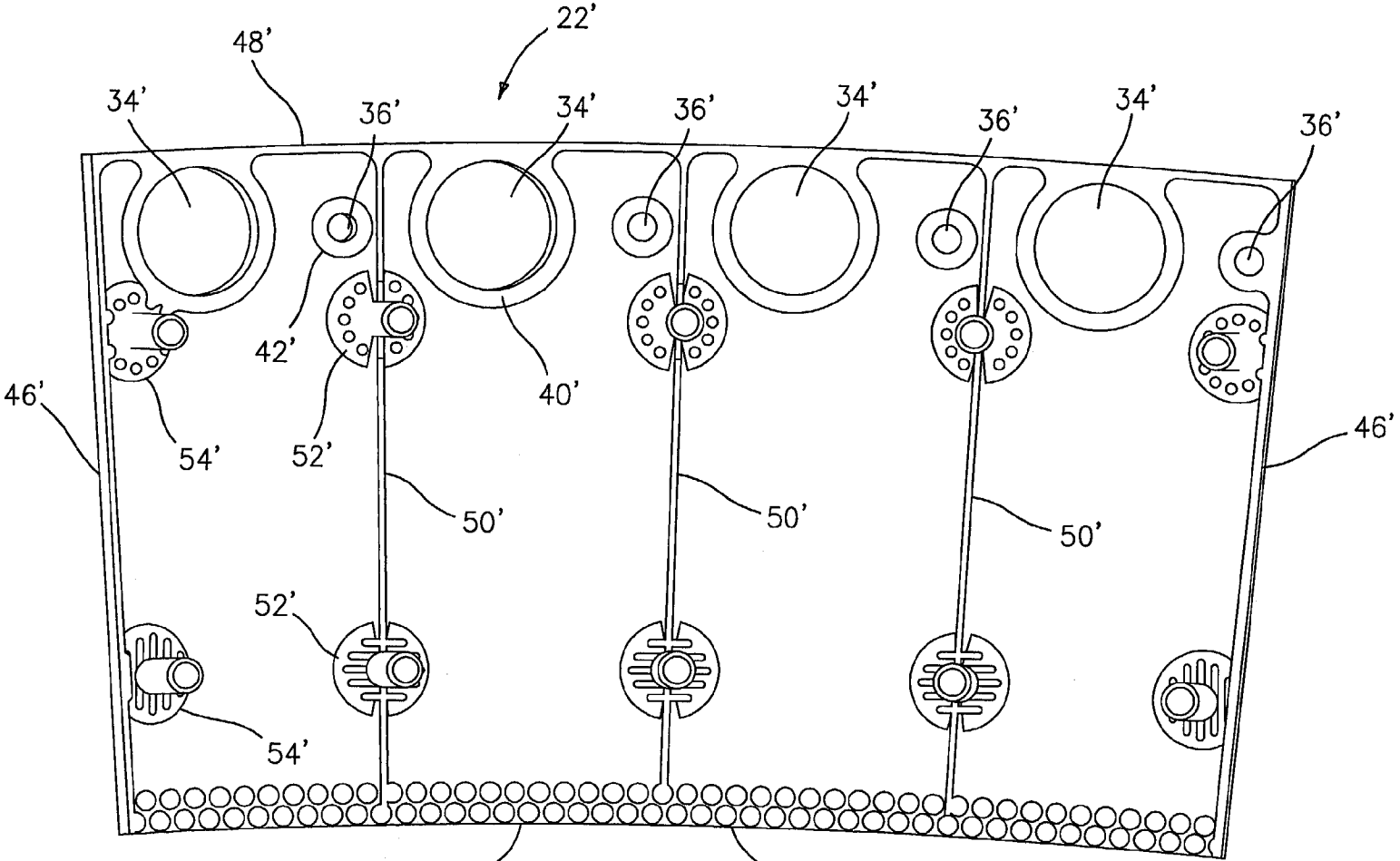
FIG. 8 is a view of an alternative embodiment of an inner forward heat shield panel.

Referring now to FIGS. 7 and 8, alternative embodiments of the forward heat shield panels 18' and 22' are illustrated. As can be seen from FIG. 7, the panel 18' has a boundary wall which includes side peripheral wall segments 46' and a rear or trailing edge peripheral wall segment 48'. The peripheral wall segment 48' extends radially and contacts the support shell 12 when properly positioned. This helps in directing the cooling air that impinges on the cold side of panel 18' to flow toward the panel cooling film holes 32' and exit through them. The contact of the wall segments 46' and 48' with the support shell 12 helps eliminate the presence of leakage passages through which air could exit the panel 18' bypassing the film holes 32'. If cooling air were to bypass the film holes 32', the panel metal temperature will undoubtedly increase. This increase would be due to the lack of heat extraction through the panel holes and the lack of protection from a film created by air exiting the panel holes 32' and hugging the hot surface of the panel 18'. Additionally, cooling air that is allowed to bypass the panel film holes 32' will not remain close to the panel surface but rather, will tend to freely flow towards the center of the chamber 16. It will burn in the fuel rich mixture of the rich burn zone and therefore increase the local gas temperature scrubbing the panel 18' as well as increase the production of pollutants.

As shown in FIG. 7, the panel 18' also has a plurality of inner rails 50' which divide the cold side of the panel 18' into a plurality of cooling chambers 56'. A plurality of attachment posts 52' are typically aligned with the inner rails 50'. Also, a plurality of attachment posts 54' are positioned near the side peripheral wall segments 46'. As before, the panel 18' has a plurality of major dilution holes 34', each surrounded by a raised rim 40', and a plurality of minor dilution holes 36' each surrounded by a raised rim 42'.

Panel 18' differs from panel 18 in that the front peripheral wall segment 44 has been replaced by a means for metering the flow of air over the panel edge. These metering means preferably takes the form of an array of round pins 90. As can be seen from FIG. 7, the round pins 90 are formed into a plurality of rows with the pins 90 in one row being offset from the pins 90 in an adjacent row. The pins 90 meter the cooling air leaving the panel 18'. This air is used to cool the leading edge 92 of the panel 18' as well as the outer and inner edges and lips of the bulkhead segment 94. The pins 90 may be spaced apart by any distance which achieves the desired cooling effect and a desired rate of cooling air flowing over the edge 92. While the front row of pins 90 has been shown as being positioned near the leading edge 92, the front row of pins 90, if desired, could be recessed or spaced a distance away from the leading edge 92. The pins 90 have a height which allows the top of the pins to contact the support shell 12 when the panel 18' is properly positioned.

One of the panels 18' attached to the support shell 12 may have one or more openings 96 for receiving an ignitor (not shown).

Referring now to FIG. 8, an alternative embodiment of a front heat shield panel 22' to be mounted to the inner support shell 14 is illustrated. As before, the panel 22' has a boundary formed by side wall rail segments 46' and a rear peripheral wall 48', a plurality of major dilution holes 34', each surrounded by a raised rim 40', a plurality of minor dilution holes 36', each surrounded by a raised rim 42', inner rails 50', and a plurality of isolated cooling chambers 56'. Attachment posts 52' are typically aligned with the inner rails 50' and attachment posts 54' are positioned adjacent or next to the side wall segments 46'. The rear wall 48' helps guide the cooling air through the film cooling holes 32' and towards the leading edge 98 of the panel 22'.

In lieu of a front peripheral wall 44, the panel 22' also has means for metering the flow of cooling air over the leading edge 98 of the panel. The metering means preferably comprises a plurality of rows of round pins 100, preferably two rows of such pins. As can be seen from FIG. 8, the pins 100 in one row are offset with respect to the pins 100 in an adjacent row. As before, the pins 100 may be separated by any desired distance sufficient to achieve a desired cooling air flow rate over the leading edge 98 and onto the bulkhead segment 94. While the front row of pins 100 has been illustrated as being near the leading edge 98, the front row of pins 100 may be recessed or spaced away from the leading edge 98 if desired. The pins 100 have sufficient height that the top of the pins 100 contact the support shell 14 when the panel 22' is installed.

In both panel 18' and panel 22', the two mechanisms that provide heat extraction from the leading edge of the panels are convection from the pins on the cold side and protection from hot gases by the film layer created as the cooling air is channeled and directed toward the hot surface of the panel. While not shown in FIGS. 7 and 8, the panels 18' and 22' are each provided with a cooling hole 32 configuration such as shown in and discussed with respect to FIG. 5.

As shown in FIG. 1, the outer and inner support shells 12 and 14 are connected to the first row of stator vanes 102 in the engine turbine section. The stator vanes 102 cause bow waves which may cause damage to the combustor and shorten its service life. The panels 20' and 24' help avoid the problem of bow wave damage.

Figure 9:
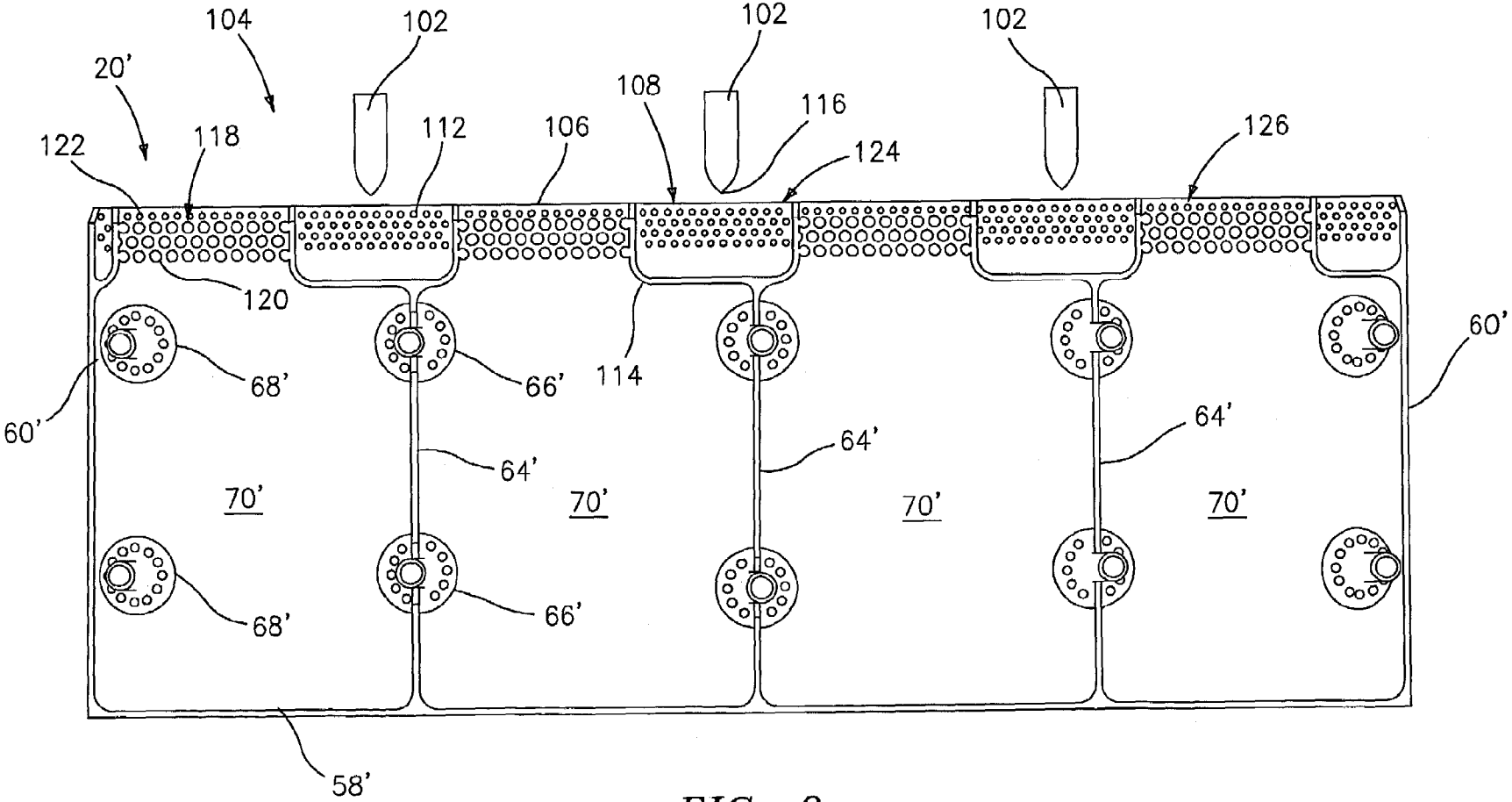
FIG. 9 is a view of an alternative embodiment of an outer rear heat shield panel.
Figure 10:
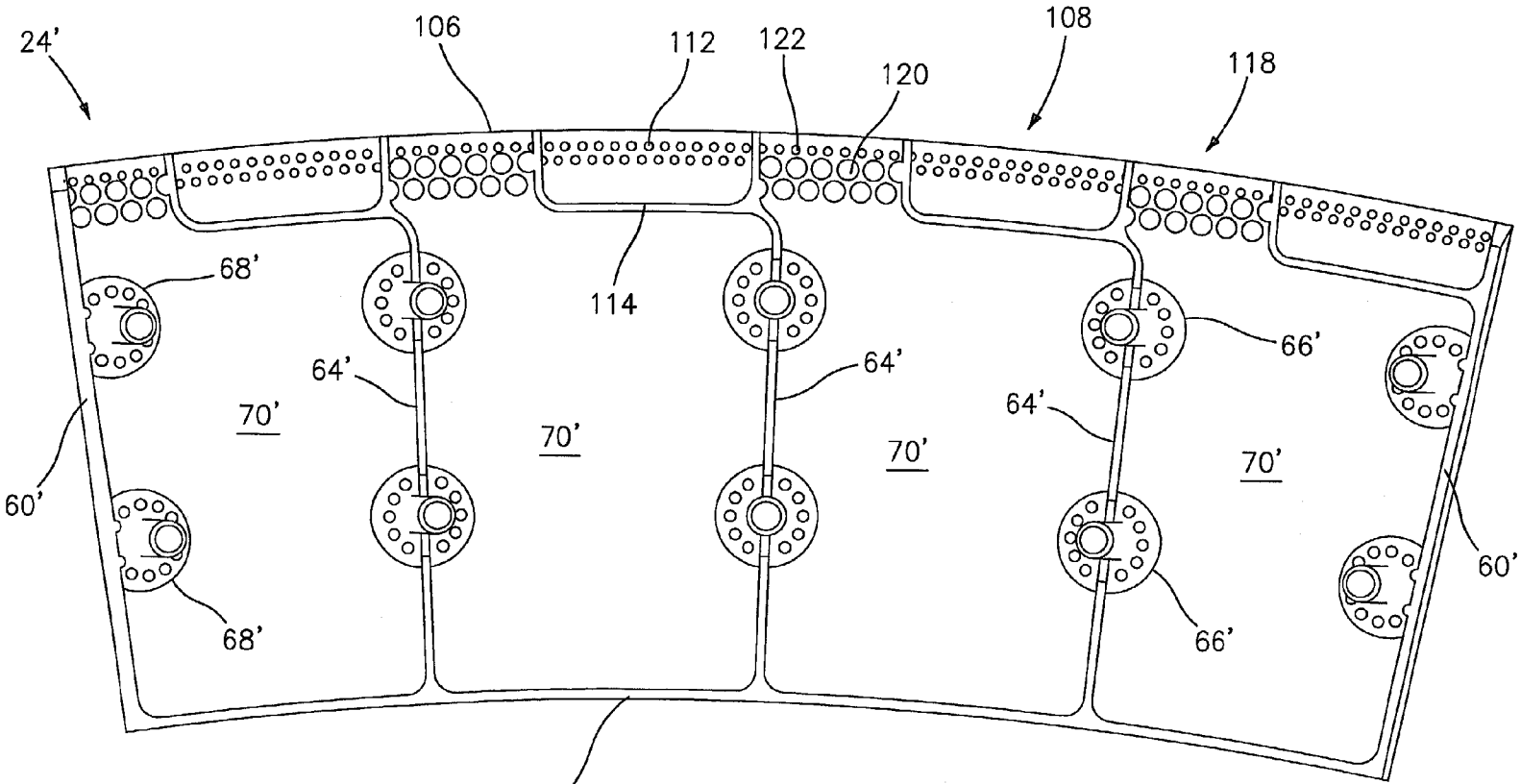
FIG. 10 is a view of an alternative embodiment of an inner rear heat shield panel.

Referring now to FIGS. 9 and 10, each of the panels 20' and 24' have a boundary which is at least partially defined by a forward rail 58' and side rails 60'. The rails 58' and 60' contact the respective support shell 12 or 14 when the panel 20' and 24' is installed and thus help force cooling air through the film holes 32 and towards the trailing edge 106 of the respective panel 20' or 24'. The panels 20' and 24' also have a plurality of inner rails 64' which form a plurality of cooling chambers 70' on the cold side. A plurality of attachment posts 66' are typically aligned with each inner rail 64' and a plurality of attachment posts 68' are located adjacent or next to the side rails 60'.

Each of the panels 20' and 24' no longer have a rear rail 62. Instead, each of the panels 20' and 24 has a means for metering the flow of cooling air over the trailing edge 106 of the respective panel 20', 24'. The metering means includes an array 104 of round pins adjacent the trailing edge 106 of the respective panel 20' and 24'. The pins in each array 104 extend to the respective support shell 12 or 14 when the panel 20' and 24' is installed.

The pin array 104 includes a plurality of first array sections 108. As can be seen from FIGS. 9 and 10, each section 108 has a plurality of rows of pins 112 with adjacent rows of pins 112 being offset. Further, each section 108 is surrounded by a substantially rectangular rail 114. Each of the sections 108 is aligned with the leading edge 116 of the first turbine stator vane 102.

The distinct cavity created by the rail 114 and by the loose array of pins 112 secures a supply of cooling air to the vane platform (not shown) and to the panel trailing edge 106. As a result of the flow over each turbine vane 102, a vortical flow structure is created on the leading edge 116. This vortex wraps around the suction and pressure side of the respective vane 102 along its entire span. At the vane platform, this vortex interacts with the cold side cooling air and film from the rear heat shield panel 20' and 24' to generate a strong secondary flow system. The high pressure vortex which is generated obstructs the constant flow of cooling air from the cold side and brings hot gases from the mid-span region of the combustion chamber exit. Due to the above-mentioned flow behavior, an increase in the mass flow of cooling air directed at the vane leading edge 116 is needed to wash away the vortical structure and clear the region of hot gases. This increase is achieved locally by separating the flows on the trailing edge 106 of the panel with the rail 114.

In regions circumferentially offset from the vanes 102, the metering means includes a relatively tight pin array 118, which is translated into low cooling airflow. The pin array 118 is provided to keep this region below the design metal temperature while guaranteeing an adequate cooling flow through the panel film cooling holes 32. As can be seen from FIGS. 9 and 10, each pin array 118 includes a plurality of rows of offset pins 120 having a diameter larger than the diameter of the pins 112. Further, the spacing between adjacent pins 120 is less than the spacing between adjacent pins 112. If desired, a row of pins 122 having a diameter smaller than that of the pins 120 may be included as a sacrificial feature in case burning occurs since it would be undesirable to lose a row of pins 120 due to burning. Such a loss would considerably decrease the flow resistance in this region and hence starve the panel film holes 32 of needed cooling air. The pins 122 are preferably offset from the pins 120 in the adjacent row.

Furthermore, while the pin arrays 108 and 118 have been shown to have an end row 124 and 126 respectively near the trailing edge 106 of the panel 20', 24', the end rows 124 and 126 may be spaced away or recessed from the trailing edge 106.

The pin arrays on the panels 18' and 22' allow some of the paneling air to be used three times to transfer heat out of the panel as the coolant impinges on the panel at a 90 degree angle, to transfer heat out of the panel as it flows past the pins, and to prevent heat from getting into the panel by forming a film on the hot side of the panel. The pin arrays at the aft end of the panels 20' and 24' allow similar things, except that a film is formed on and protects the platform of the first turbine stator vane. Further, the area on the panels 20' and 24' that prevents the vane bow wave from damaging the combustor has a loose cooling pin array which is angled toward the vane. This allows the air to maintain a higher total pressure to counteract the bow wave.

Figure 11:
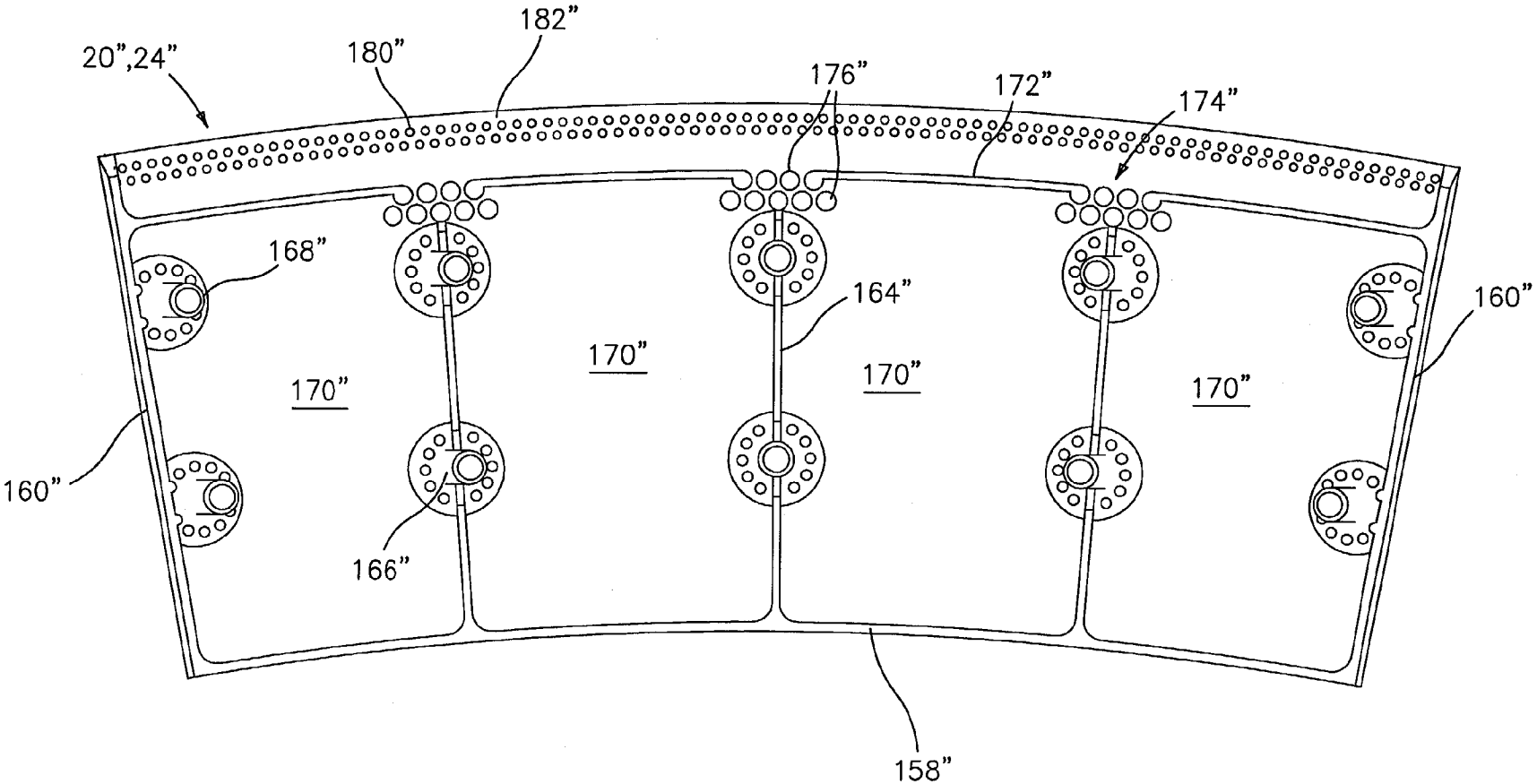
FIG. 11 is a view of yet another alternative embodiment of a forward heat shield panel.

Referring now to FIG. 11, another alternative embodiment of a rear heat shield panel 20", 24" is illustrated. In this embodiment, the panel 20", 24" has side walls 160", forward wall 158", and a plurality of inner rails 164" which define a plurality of chambers 170". The panel 20", 24" has a rear wall 172" which has a plurality of flow metering segments 174". The flow metering segments 174" are formed by an array of offset pins 176". Each panel 20", 24" has an array of offset pins 180" near or recessed from a trailing edge 182" of the panel. The pins 180" also function as a means for metering the cooling air flow over the trailing edge 182" of the panel. The pins 180" may be arranged in rows of offset pins. The spacing between the pins 176" and 180" define the flow rate of cooling air over the trailing edge 182". The panels 20", 24" also have a pair of attachment posts 166" typically aligned with each of the rails 164" and a pair of attachment posts 168" positioned near the sidewalls 160". While not shown in FIG. 11, each panel 20", 24" has a first set of cooling holes with a first desired orientation, such as 90 degrees with respect to the mean combustor airflow direction M, and additional sets of cooling holes near the posts 168" and 166", the rails 164", and the walls 160", 158", and 164". The additional sets of cooling holes near the posts 166" and 168" are arranged in a fan pattern and are oriented towards the posts 166" and 168". The cooling holes near the walls 160" and 158" and the rails 164" are preferably oriented towards the walls 160" and 158" and the rails 164" to provide cooling air to cool these features.

Figure 12:
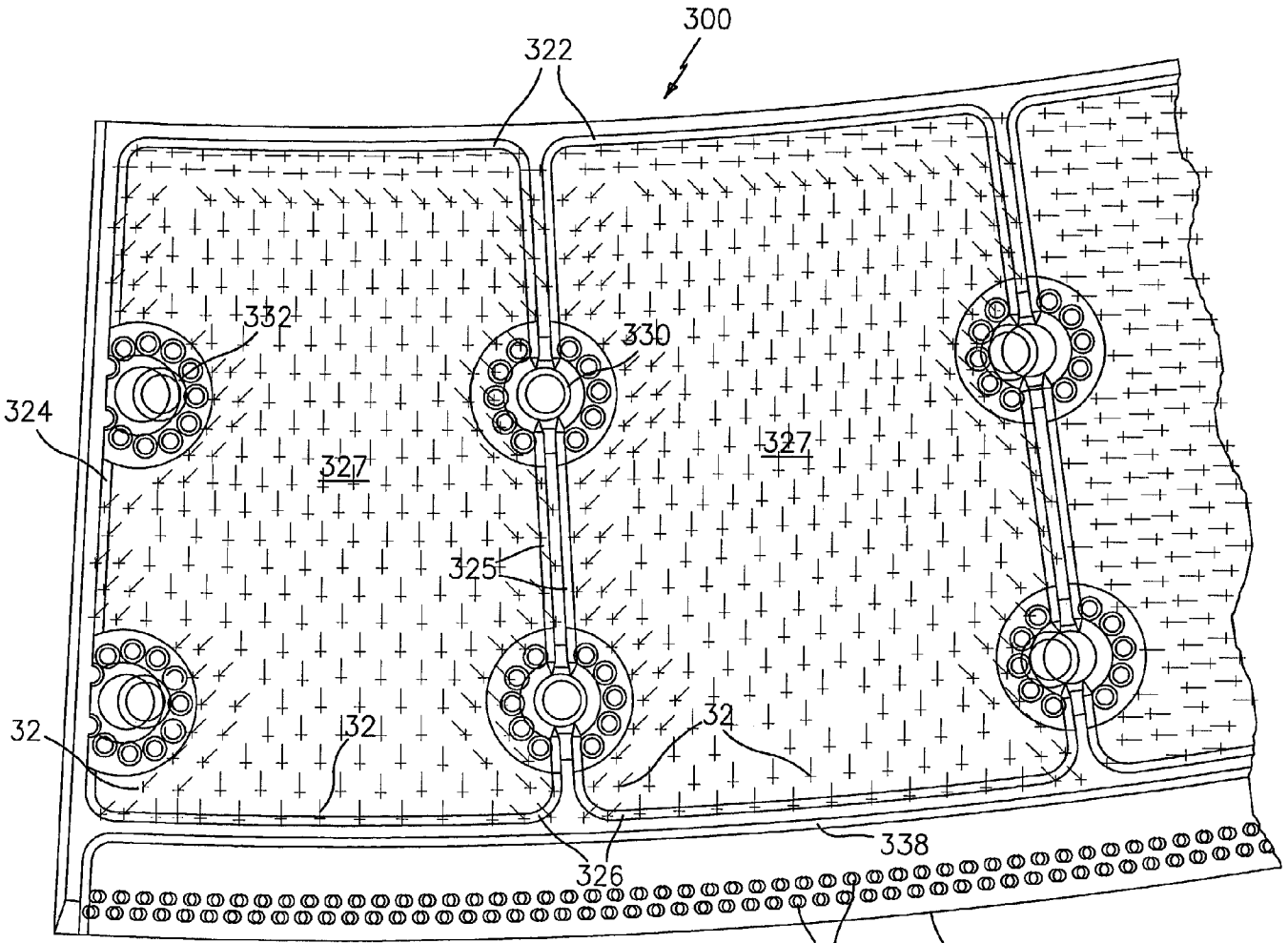
FIG. 12 is a view of another alternative embodiment of a rear heat shield panel.

FIG. 12 is an alternative heat embodiment of a rear heat shield panel 320 for use in a combustor of a gas turbine engine as either an outer rear heat shield panel or an inner heat shield panel. The panel 320 has a forward rail 322, side rails 324, inner rails 325, and a rear rail 326 forming a plurality of chambers 327. The cooling holes 32 in the region 328 are straight back holes, while the cooling holes 32 near where the side rails 324 meet the rails 322 and 326 are angled toward the rails. Further, the cooling holes in the vicinity of the inner rails 325 and the attachment posts 330 and 332 are angled towards the inner rails 325 and the attachment posts 330 and 332 respectively. The panel 320 further has a plurality of rows of pins 334 for metering the flow of cooling air over the panel edge 336. As before, the rows of pins 334 are offset. The diameter of the pins 334 and their spacing determine the flow rate of the cooling air. If desired, a rail 338 may be placed around the rows of pins 334.

Figure 13:
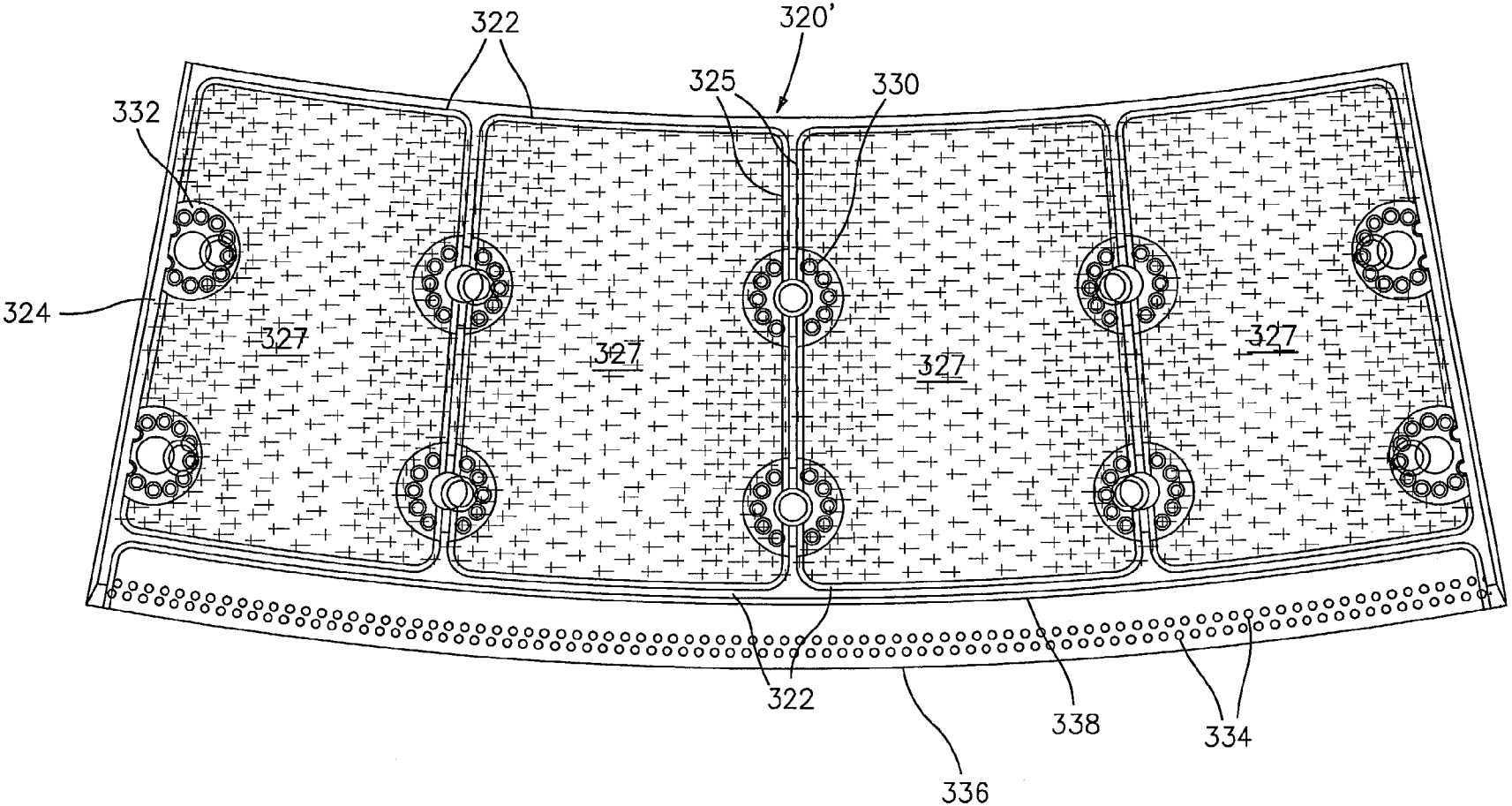
FIG. 13 is a view of another alternative embodiment of a rear heat shield panel.

FIG. 13 illustrates another embodiment of a heat shield panel 320' which may be used for the inner and outer rear heat shield panels. The panel 320' is identical to the panel 320 except for the cooling holes 32 in the region 328 being oriented 90 degrees with respect to the mean combustor airflow direction M.

It is apparent from the foregoing description that there has been provided heat shield panels for use in a combustor for a gas turbine engine which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A heat shield panel for use in a combustor for a gas turbine engine, comprising:

a hot side and a cold side;

said cold side having a plurality of cooling chambers;

each said cooling chamber having a plurality of film holes for allowing a coolant to flow from said cold side to said hot side;

said cold side having a front boundary wall and a rear boundary wall;

a plurality of inner rails extending between said front boundary wall and said rear boundary wall;

at least one of said cooling chambers being formed by said front boundary wall, said rear boundary wall, and said inner rails; and said front boundary wall having a means for metering air flow over a leading edge of said panel and said metering means being formed by a plurality of rows of spaced apart pins.

2. A heat shield according to claim 1, wherein said pins in adjacent ones of said rows are offset from each other.

3. A heat shield panel according to claim 1, wherein a forward end row of said pins is spaced from a leading edge of said panel.

4. A heat shield panel for use in a combustor for a gas turbine engine, comprising:

a hot side and a cold side;

said cold side having a plurality of cooling chambers;

each said cooling chamber having a plurality of film holes for allowing a coolant to flow from said cold side to said hot side;

said cold side having a front boundary wall and a rear boundary wall;

a plurality of inner rails extending between said front boundary wall and said rear boundary wall;

at least one of said cooling chambers being formed by said front boundary wall, said rear boundary wall, and said inner rails; and said rear boundary wall being formed by a means for metering air flow over an edge of said panel and said metering means comprising a plurality of first pin arrays and a plurality of second pin arrays.

5. A heat shield panel according to claim 4, further comprising each of said first pin arrays being aligned with a turbine vane.

6. A heat shield panel according to claim 5, further comprising each of said first pin arrays comprising a plurality of rows of pins having a first diameter and a substantially rectangular rail surrounding said rows of pins having said first diameter.

7. A heat shield panel according to claim 6, wherein said pins in a first of said rows is offset from said pins in an adjacent row.

8. A heat shield panel according to claim 6, further comprising each of said second pin arrays being offset from said turbine vane and comprising a plurality of rows of pins having a second diameter.

9. A heat shield panel according to claim 8, wherein said pins in one of said rows in each said second pin array is offset with respect to said pins in an adjacent row.

10. A heat shield panel according to claim 8, wherein said second diameter is larger than said first diameter.

11. A heat shield panel according to claim 8, wherein said pins in each said first pin array are spaced apart a distance greater than a spacing distance of said pins in each said second pin array.

12. A heat shield panel according to claim 8, further comprising each said second pin array having a row of sacrificial pins.

13. A heat shield panel according to claim 12, wherein said row of sacrificial pins is located adjacent a trailing edge of said panel.

14. A heat shield panel according to claim 12, wherein said row of sacrificial pins is recessed away from a trailing edge of said panel.

15. A heat shield panel according to claim 6, wherein a rearward most one of said pin rows is positioned near a trailing edge of said panel.

16. A heat shield panel according to claim 6, wherein a rearward most one of said pin rows is positioned spaced from a trailing edge of said panel.

17. A heat shield panel for use in a combustor for a gas turbine engine, comprising:

a hot side and a cold side;

said cold side having a plurality of cooling chambers;

each said cooling chamber having a plurality of film holes for allowing a coolant to flow from said cold side to said hot side;

a plurality of major dilution holes and a plurality of minor dilution holes positioned adjacent a trailing edge of said panel; and said panel having axially extending rails and attachment posts and wherein said cooling holes have an orientation on one side of each said rail and each said attachment post which is locally reversed so that said coolant flows over said rail and said attachment post.

18. A heat shield panel for use in a combustor for a gas turbine engine, comprising:

a hot side and a cold side;

said cold side having a plurality of cooling chambers;

each said cooling chamber having a plurality of film holes extending from said cold side to said hot side for allowing a coolant to flow from said cold side to said hot side;

a plurality of major dilution holes and a plurality of minor dilution holes positioned adjacent a trailing edge of the panel; and wherein the density of said cooling holes in the vicinity of said major dilution holes is increased.

19. A heat shield panel for use in a combustor for a gas turbine engine, comprising:

a hot side and a cold side;

said cold side having a plurality of cooling chambers;

each said cooling chamber having a plurality of film holes for allowing a coolant to flow from said cold side to said hot side;

each of said cooling chambers having an axially extending zigzag line located circumferentially midway between wall portions forming sides of said cooling chamber;

said cooling holes on a first side of said zigzag line all being obliquely oriented so that the coolant issues from said cooling holes with a first circumferential direction component toward a first one of said side wall portions; and said cooling holes on a second side of said zigzag line all being obliquely oriented so that the coolant issues from said cooling holes with a second circumferential direction component toward a second one of said side wall portions.

20. A heat shield panel according to claim 19, wherein said cooling holes on said first side of said zigzag line have a positive orientation and said cooling holes on said second side of said zigzag line have a negative orientation.

21. A combustor for a gas turbine engine comprising:

an outer support shell and an inner support shell;

said inner and outer support shells forming a combustion chamber;

an array of forward heat shield panels attached to said inner and outer support shells;

an array of rear heat shield panels attached to said inner and outer support shells;

said forward heat shield panels each having a plurality of dilution holes through which air passes into said combustion chamber;

said rear heat shield panels each having a plurality of rails; and said rails in each said rear heat shield panel being circumferentially offset with respect to radially opposed ones of said dilution holes to mitigate any loss of cooling effectiveness.

22. A combustor according to claim 21, wherein said dilution holes are major dilution holes.

23. A combustor according to claim 21, wherein each of said rails has a pair of attachment posts aligned therewith.

24. A combustor according to claim 21, wherein each said rear heat shield panel is offset with respect to an adjacent one of said forward heat shield panels so that each said rail is aligned with one of said dilution holes.

25. A combustor according to claim 21, wherein each said forward heat shield panel has a rear wall and side wall segments which contact an adjacent one of said inner and outer support shells.

26. A combustor according to claim 25, wherein each said forward heat shield panel has a plurality of inner rails and wherein said inner rails form a plurality of isolated cooling chambers with said rear wall and said side wall segments.

27. A combustor according to claim 26, wherein each said cooling chamber has a plurality of film cooling holes and wherein said rear wall directs cooling air over said cooling holes and over a leading edge of said forward heat shield panel.

28. A combustor according to claim 27, wherein each said forward heat shield panel has a means for metering coolant air flow over said leading edge, said metering means comprises a plurality of rows of round pins near a forward end of each said cooling chamber.

29. A combustor according to claim 28, wherein said pins in each said row are spaced apart to allow said cooling air to flow over said leading edge.

30. A combustor according to claim 29, wherein pins in adjacent ones of said rows are offset from each other.

31. A combustor according to claim 27, further comprising a bulkhead segment and said cooling air flowing over said leading edge also cooling said bulkhead segment.

32. A combustor according to claim 21, further comprising:

each said rear heat shield panel having a forward peripheral wall and side walls which contact an adjacent one of said inner and outer support shells; and said forward peripheral wall and said side walls forming a plurality of cooling chambers with said rails.

33. A combustor according to claim 32, further comprising:

each said cooling chamber having a plurality of film cooling holes; and said rear wall causing cooling air to flow over and through said film cooling holes and over a trailing edge of said rear heat shield panel.

34. A combustor according to claim 33, further comprising:

a plurality of first pin arrays adjacent a rear portion of each said cooling chamber; and each of said first pin arrays being aligned with a turbine vane so that cooling air exiting each said first pin array flows over surfaces of said turbine vane to prevent bow wave damage to said combustor.

35. A combustor according to claim 34, further comprising a substantially rectangular rail about each said first pin array.

36. A combustor according to claim 34, wherein each said first pin array comprises a plurality of rows of first pins.

37. A combustor according to claim 36, wherein said first pins in each row are offset from said first pins in each adjacent row.

38. A combustor according to claim 34, further comprising a plurality of second pin arrays adjacent said rear portion of each said cooling chamber and each second pin array being offset from said turbine vane.

39. A combustor according to claim 38, wherein each said second pin array comprises a plurality of rows of second pins and a row of sacrificial pins.

40. A combustor according to claim 39, wherein said second pins in each of said rows is offset with respect to said second pins in each adjacent row.

41. A combustor according to claim 39, wherein each said first array comprises a plurality of rows of first pins and wherein said first pins have a diameter smaller than a diameter of said second pins.

42. A combustor according to claim 41, wherein adjacent ones of said second pins are spaced closer together than adjacent ones of said first pins.

43. A combustor according to claim 21, wherein each of said forward heat shield panels and said rear heat shield panels has a plurality of cooling chambers and wherein each of said inner and outer support shells have a plurality of impingement holes for supplying cooling air to said cooling chambers.

44. A combustor according to claim 43, wherein each of said cooling chambers has a plurality of film cooling holes for creating a film of cooling air over a hot side of a respective one of said forward and rear heat shield panels.

45. A heat shield panel for use in a combustor for a gas turbine engine, comprising:

a hot side and a cold side;

a plurality of cooling holes extending from said hot side and said cold side;

a plurality of inner rails on said cold side of said panel;

a first set of said cooling holes circumferentially proximate said rails comprising oblique cooling holes; and remaining ones of said cooling holes being oriented at zero degrees or ninety degrees with respect to a mean combustor airflow direction.

46. A heat shield panel for use in a combustor for a gas turbine engine, comprising:

a cold side and a hot side;

a plurality of film cooling holes extending from said cold side to said hot side;

an end wall and a pair of side walls extending from said cold side and mating with a support shell of said combustor, said end wall and said pair of side walls directing coolant air through said plurality of film cooling holes so as to form a film of coolant air over said hot side; and means near an edge of said panel for metering flow of said coolant air over said edge of said panel and for exhausting said coolant air to flow over said panel edge.

47. A heat panel according to claim 46, wherein said flow metering means comprises at least one row of spaced apart pins and wherein said spacing between said pins of said at least one row determines a flow rate of said cooling air over said edge.

48. A heat panel according to claim 46, wherein said flow metering means comprises a plurality of rows of spaced apart pins with said pins in adjacent rows being offset.

49. A heat panel according to claim 46, wherein said flow metering means comprises a plurality of first pin arrays and a plurality of second pin arrays with said pins in said second pin arrays having a different size and spacing than said pins in said first pin arrays.

50. A heat panel according to claim 49, wherein said first pin arrays are surrounded by a substantially rectangular rail.

51. A heat shield panel for use in a combustor for a gas turbine engine comprising:

at least one chamber on a cold side of said heat shield panel;

a first set of cooling holes passing through said heat shield panel;

a second set of cooling holes passing through said heat shield panel, said second set of cooling holes having a different angular orientation than said first set of cooling holes; and said at least one chamber is bounded by a rail and said first set of cooling holes are oriented to blow cooling air onto said rail.

52. A heat shield panel for use in a combustor for a gas turbine engine comprising:

at least one chamber on a cold side of said heat shield panel;

a first set of cooling holes passing through a wall of said heat shield panel;

a second set of cooling holes passing through said wall of said heat shield panel, said second set of cooling holes having a different angular orientation than said first set of cooling holes; and further comprising at least one attachment post and said first set of cooling holes being oriented to blow cooling air onto said at least one attachment post.

53. A heat shield panel for use in a combustor for a gas turbine engine comprising:

at least one chamber on a cold side of said heat shield panel;

a first set of cooling holes passing through said heat shield panel;

a second set of cooling holes passing through said heat shield panel, said second set of cooling holes having a different angular orientation than said first set of cooling holes; and at least one dilution hole and said first set of cooling holes being oriented to blow cooling air towards said dilution hole.

54. A heat shield for use in a combustor for a gas turbine engine comprising:

at least one chamber on a cold side of said heat shield panel;

a first set of cooling holes passing through said heat shield panel;

a second set of cooling holes passing through said heat shield panel, said second set of cooling holes having a different angular orientation than said first set of cooling holes;

at least one dilution hole and said first set of cooling holes being oriented to blow cooling air towards said dilution hole; and wherein said panel has an end wall and said first set of cooling holes are positioned adjacent said end wall and are oriented at 90 degrees with respect to a mean combustor air flow direction.

* * * * *